US009907452B2

(12) United States Patent
Roth et al.

(10) Patent No.: US 9,907,452 B2
(45) Date of Patent: Mar. 6, 2018

(54) DISHWASHER UTENSIL CADDIES

(71) Applicant: Whirlpool Corporation, Benton Harbor, MI (US)

(72) Inventors: Ryan K. Roth, Saint Joseph, MI (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/868,978

(22) Filed: Sep. 29, 2015

(65) Prior Publication Data

US 2016/0095497 A1 Apr. 7, 2016

Related U.S. Application Data

(60) Provisional application No. 62/058,806, filed on Oct. 2, 2014.

(51) Int. Cl.
*A47L 15/50* (2006.01)

(52) U.S. Cl.
CPC ..... *A47L 15/502* (2013.01); *A47L 15/505* (2013.01)

(58) Field of Classification Search
CPC ..... A47L 15/502; A47L 15/505; A47B 81/04
USPC ..... 211/41.9
See application file for complete search history.

(56) References Cited

U.S. PATENT DOCUMENTS 3,665,943 A * 5/1972 Lampman ..... A47L 15/502 134/200
3,703,326 A * 11/1972 Riviers ..... A47B 81/04 206/822
3,960,290 A * 6/1976 Yake ..... A47L 15/502 220/23.83
4,834,125 A * 5/1989 Insalaco ..... A47L 15/502 134/201
5,102,225 A * 4/1992 Hollinger ..... A47L 15/505 206/0.5
5,287,984 A * 2/1994 Michael ..... A47L 15/502 220/555
D473,985 S * 4/2003 Moreira Da Silva ..... D32/3
D487,825 S * 3/2004 Kim ..... D32/3
6,945,421 B2 * 9/2005 Phifer ..... A47L 15/502 220/486
D517,253 S * 3/2006 Raches ..... D32/3
7,137,397 B2 * 11/2006 Rosenbauer ..... A47L 15/502 134/200
7,383,846 B2 * 6/2008 Curran ..... A47L 15/502 134/135

(Continued)

FOREIGN PATENT DOCUMENTS

DE 3520148 A1 * 12/1986 ..... A47L 15/502
DE 19540609 A1 * 5/1997 ..... A47L 15/502

(Continued)

*Primary Examiner* — Stanton L Krycinski
(74) *Attorney, Agent, or Firm* — McGarry Bair PC

(57) ABSTRACT

Dishwasher utensil caddies are disclosed. A disclosed example utensil caddy for a dishwasher having a tub and a door at least partially defining a treating chamber, and dish rack in the treating chamber, includes an attachment member configured to attach the utensil caddy to a side of the dish rack in a space between the dish rack and the tub or the door, and a slot oriented at an angle relative to the dish rack, and configured to receive a handle of a cooking utensil.

15 Claims, 3 Drawing Sheets

(56) References Cited

U.S. PATENT DOCUMENTS

| | | | | |
|---|---|---|---|---|
| 7,594,513 | B2 | 9/2009 | Vanderroest et al. | |
| 7,909,181 | B2 * | 3/2011 | Purushothaman | A47L 15/503 211/41.8 |
| 8,377,227 | B2 * | 2/2013 | Bengston | A47L 15/502 134/135 |
| 8,522,998 | B2 * | 9/2013 | Crookshanks | A47L 15/502 211/41.8 |
| 8,733,859 | B2 * | 5/2014 | Shewmaker | A47L 15/502 211/41.9 |
| 8,789,711 | B2 * | 7/2014 | Haltmayer | A47L 15/503 211/41.9 |
| 8,905,495 | B2 * | 12/2014 | Garnett | A47L 15/502 312/228.1 |
| 9,226,643 | B2 * | 1/2016 | Garnett | A47L 15/502 |
| 2005/0045215 | A1 * | 3/2005 | Raches | A47L 15/502 134/135 |
| 2007/0039636 | A1 * | 2/2007 | Egger | A47L 15/502 134/56 D |
| 2007/0039905 | A1 * | 2/2007 | Purushothaman | A47L 15/505 211/41.8 |
| 2008/0302397 | A1 | 12/2008 | Buehlmeyer et al. | |
| 2013/0002107 | A1 * | 1/2013 | Paschini | A47L 15/502 312/228.1 |

FOREIGN PATENT DOCUMENTS

| | | | | |
|---|---|---|---|---|
| DE | 10322096 | A1 * | 12/2004 | A47L 15/502 |
| EP | 1275336 | A1 * | 1/2003 | A47L 15/502 |
| EP | 1281347 | A1 | 2/2003 | |
| EP | 1413241 | A1 | 4/2004 | |
| EP | 1241974 | B1 | 10/2004 | |
| EP | 2047787 | A1 * | 4/2009 | A47L 15/502 |
| EP | 1281346 | B1 | 12/2009 | |

* cited by examiner

DISHWASHER UTENSIL CADDIES

RELATED APPLICATIONS

This application claims the priority benefit of U.S. Provisional Patent Application No. 62/058,806, filed on Oct. 2, 2015, and entitled Dishwasher Utensil Caddies, the entirety of which is incorporated herein by reference.

FIELD OF THE DISCLOSURE

This disclosure relates generally to dishwashers, and, more particularly, to dishwasher utensil caddies.

BACKGROUND

Conventional dishwashers perform cycles of operation on items present in the dishwasher, and have racks to hold the items.

SUMMARY

A disclosed example utensil caddy for a dishwasher having a tub and a door at least partially defining a treating chamber, and dish rack in the treating chamber, includes an attachment member configured to attach the utensil caddy to a side of the dish rack in a space between the dish rack and the tub or the door, and a slot oriented at an angle relative to the dish rack, and configured to receive a handle of a cooking utensil.

A disclosed example dishwasher rack assembly includes a dish rack, and a utensil caddy having an attachment member to attach the utensil caddy to a side of the dish rack and dimensioned to fit in a space between the dish rack and a tub or door of a dishwasher, and a slot oriented at an angle relative to the dish rack, and configured to receive a handle of a cooking utensil

DETAILED DESCRIPTION

In a conventional dishwasher, the upper dish rack is shallower than the lower dish rack because the door of the dishwasher is thicker at the top than at the bottom to accommodate control electronics, etc. Furthermore, conventional dishwashers often do not accommodate larger cooking utensils very well, as there is no dedicated space for them, especially if the dishwasher does not include a third dish rack (i.e., a second upper rack). These items may be too long to be placed in a silverware basket, they may take up too much room if laid in the upper rack, or if placed on top of other dishes they may create shadowing, which could lower wash performance. If laid horizontally, such as in a third level rack they may capture a puddle of water that will not dry. Also some dishwashers do not include a third level rack, or the third level rack may not be deep enough to fit, for example, a large ladle.

Utensil caddies that overcome at least some these problems are disclosed herein. Disclosed example utensil caddies take advantage of the space in a treating chamber that is reclaimed by relocating control electronics, etc. from the door to another location (e.g., below the tub). By relocating the control electronics, etc. the door can be made thinner at the top, for example, substantially as thin as the bottom. Because the design and manufacturing lead time for a new dish rack may be relatively long, the disclosed example utensil caddies are configured to attach to existing dish racks between the dish rack and the door. The utensil caddies disclosed herein can be designed and manufactured with a lower capital expenditure and a shorter lead-time than new dish racks. Moreover, because the utensil caddies are selectively attachable to a dish rack, different dishwasher models can be provided with different utensil caddies. Further, the utensil caddy concepts disclosed herein could be integrated into a new, larger rack.

Figure 1:
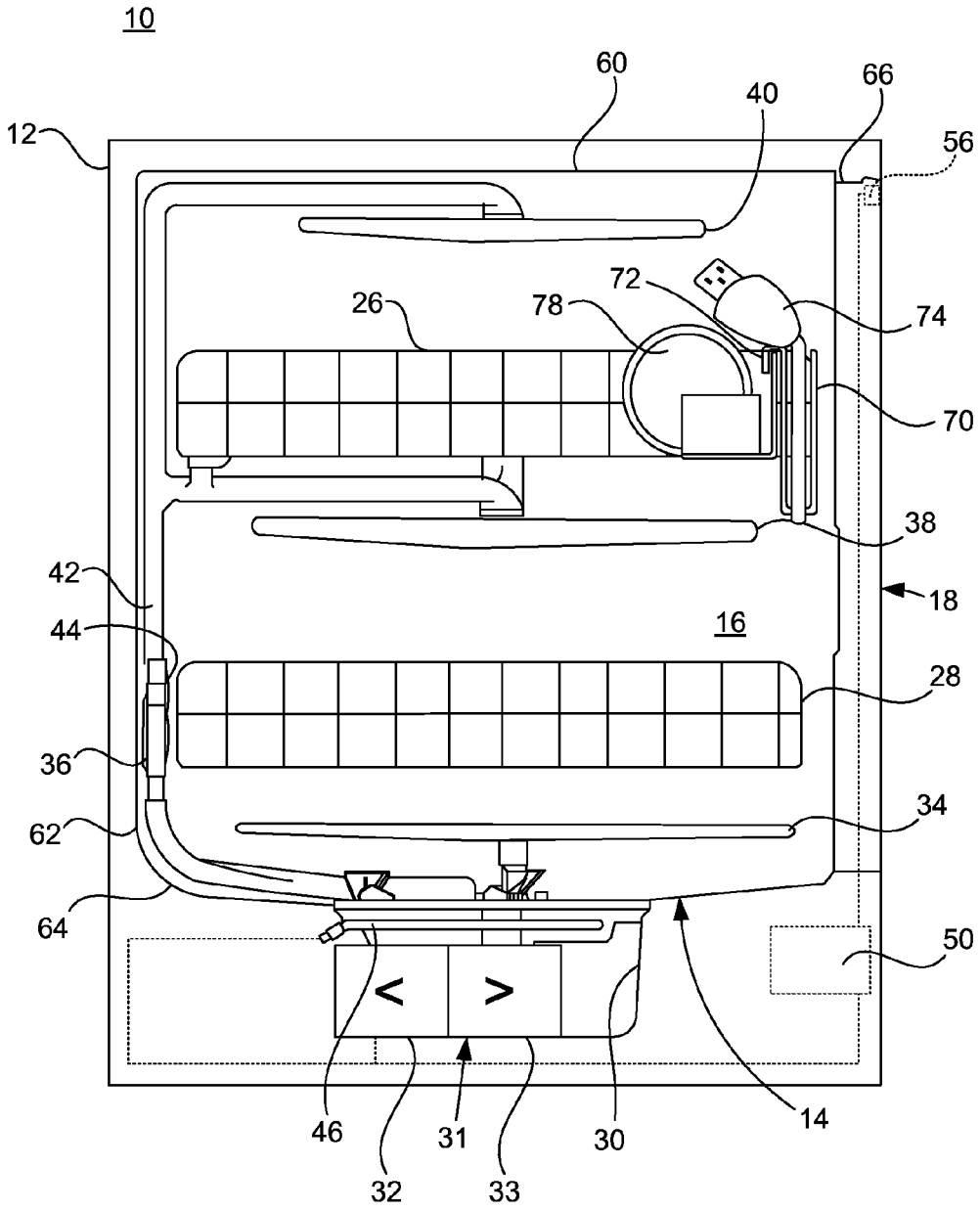
FIG. 1 is a side schematic view of an example dishwasher having a utensil caddy constructed in accordance with the teachings of this disclosure.

In FIG. 1, an automated dishwasher 10 according to a first embodiment is illustrated. The dishwasher 10 shares many well-known features of a conventional automated dishwasher, which will not be described in detail herein except as necessary for a complete understanding of this disclosure. A chassis 12 defines an interior of the example dishwasher 10 and may include a frame, with or without panels mounted to the frame. An open-faced tub 14 is within the chassis 12 and may at least partially define a treating chamber 16, having an open face, for washing dishes. A door assembly 18 is movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 is prevented, whereas user access to the treating chamber 16 is permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, silverware, and any other washable item. As used in this description, the term "utensil(s)" is intended to be generic to any item, single or plural, that may be treated in the dishwasher 10, including, without limitation, spoons, ladles, knives, spatulas, whisks, tongs, etc.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The example recirculation system includes a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 is included in the dishwasher 10, which may be operably coupled with various components of the dishwasher 10 to implement a cycle of operation. As shown in FIG. 1, the controller 50 may be located below the tub 15, or it may alternatively be located somewhere else within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

As shown in FIG. 1, because the controller 50 is implemented elsewhere than in the door 18, the door 18 can be made thinner at the top, for example, substantially as thin at the top as at the bottom. This is in contrast to a conventional dishwasher that has its controller in the door and, thus, has a door that is thicker at the top than at the bottom. To reduce capital expenditure and/or design lead-time, the upper rack 26 of FIG. 1 may be reused from a dishwasher having a door that is thicker at the top than at the bottom. Alternatively, the upper rack 26 may be purposefully designed to be shallower than the lower rack 28 to accommodate one of the example utensil caddies disclosed herein. The utensil caddies disclosed herein can take advantage of any space between a dish rack and a surface of a treating chamber, regardless of why the dish rack is shallower or narrower than the treating chamber. That is, a utensil caddy could be placed at the back, side, or front of a bottom or upper dish rack.

Figure 2:
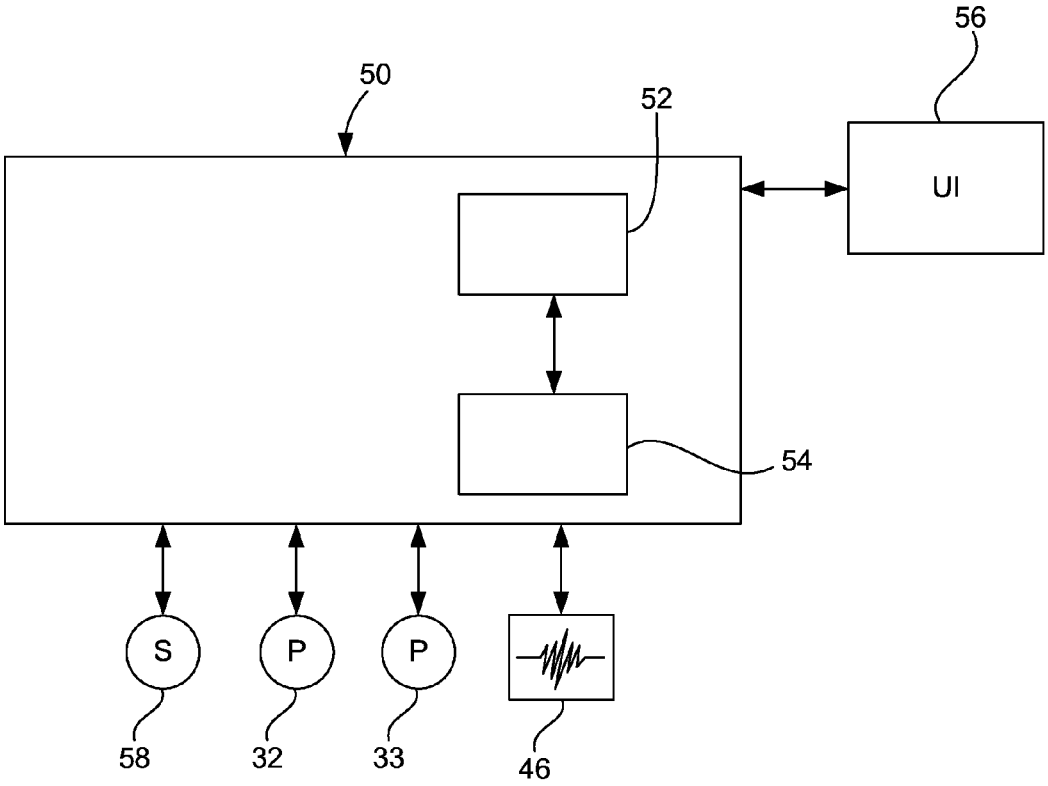
FIG. 2 is a schematic of an example control system for the example dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) or processor 54. The processor 54 can be implemented by, for example, one or more Atmel®, Intel®, AMD®, and/or ARM® microprocessors. Of course, other processors from other processor families and/or manufacturers are also appropriate.

The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The memory 52 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
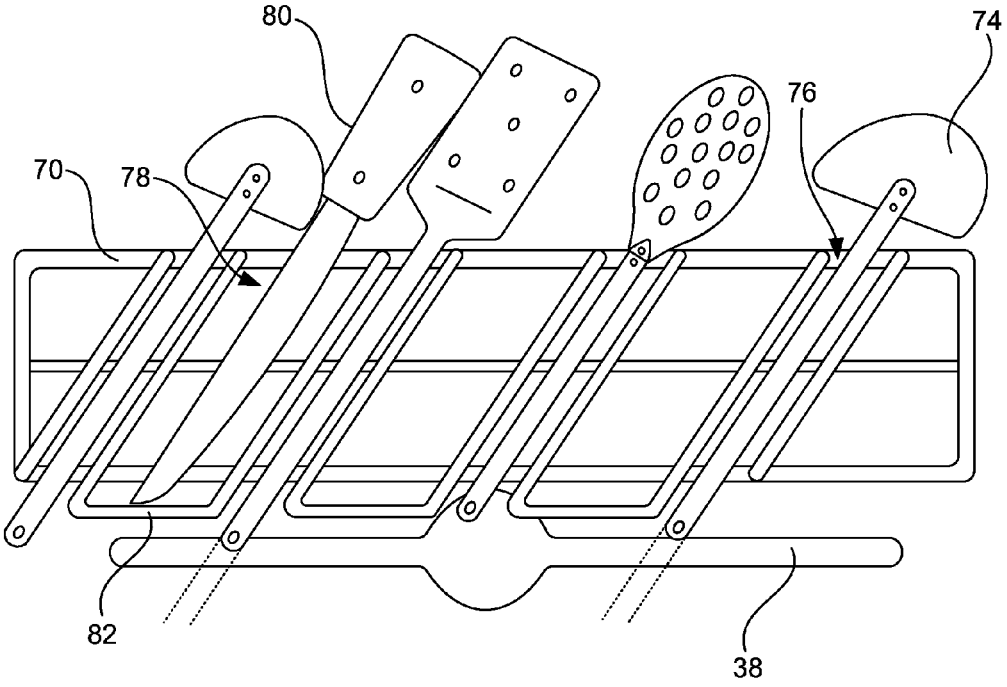
FIG. 3 is a front view of the example utensil caddy of FIG. 1.

Referring to FIGS. 1 and 3, an example utensil caddy 70 is shown that hangs on the front of the upper rack 26 between the upper rack 26 and the door 18. The example utensil caddy 70 hangs on an upper edge of the rack 26 by a hooked member 72. However, the utensil caddy 70 may attach to the upper rack 26 via any additional or alternative mechanisms and/or members. For example, the utensil caddy 70 may have a snap fit member that snap fits the utensil caddy 70 onto the rack 26, the utensil caddy 70 may have a hole or post that allows the utensil caddy 70 to be screw attached to the rack 26, etc. The utensil caddy 70 may be formed using, for example, injection molding, coated wire, etc.

To accommodate, for example, cooking utensils 74, the example utensil caddy 70 includes one or more slots, one of which is designated at reference number 76. To reduce the distance the cooking utensils 74 extend below the utensil caddy 70, the slots 76 are oriented at an angle relative to the rack 26. By reducing the distance cooking utensils 74 extend below the rack 26, the likelihood of interference with the spray arm 38 and/or the lower rack 28 is reduced. As shown in FIG. 1, the utensils 74 may be oriented front-to-back as they are placed in the utensil caddy 70 to overhang the rack 26, thereby reducing potential contact with the door 18.

As shown in FIG. 1, the large "heads" of the utensils 74 can hang over the top of the rack 26, such that interference with other items 78 being treated can be reduced or prevented, and the space taken by the utensils 74 can be reduced. Moreover, by extending the heads of utensils 74 over the rack 26, the utensils 74 can be washed without need to extend the length of the spray arm 38, which could result in spray arm—sidewall contact, or need to extend water stream trajectory toward the door 18, which could increase audible noise. Furthermore, the utensil arrangement shown in FIGS. 1 and 3 allows more utensils 74 to be placed in the new space created between the rack 26 and the door 18, by only putting the handles of the utensils 74 in this space, instead of the large heads of the utensils 74.

As shown in FIG. 3, the slots 76 may have different dimensions and/or spacing to accommodate different types of utensils 74. Slots, one of which is designated at reference numeral 78, may be included that are purpose-built to accommodate sharp items such as knives 80. Such slots 78 may, for example, include at least a partial bottom 82 to reduce contact between a user and a sharp item 80 placed in the slot 78.

While not shown, the utensil caddy 70 may include one or more baskets with or without hinged lids, for example, in the spaces between the slots 76, 78 to hold smaller items, such as, baby bottle components, pacifiers, or other small items.

In this specification and the appended claims, the singular forms "a," "an" and "the" do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone. Further still, connecting lines or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A dishwasher comprising:

a tub having walls at least partially defining a treating chamber with an access opening;

a door selectively closing the access opening;

a dish rack located within the tub; and a utensil caddy mounted to the dish rack having a top and a bottom, with a first slot extending between the top and the bottom and being open at the top and the bottom, and a second slot extending between the top and the bottom and being open at the top and closed at the bottom, wherein the first slot is at a first angle relative to the dish rack and the second slot is at a second angle relative to the dish rack.

2. The dishwasher of claim 1, wherein a dimension of the first slot is selected to accommodate a cooking utensil.

3. The dishwasher of claim 1, wherein the second slot is configured to reduce contact between a user and a knife placed in the second slot.

4. The dishwasher of claim 1, wherein the utensil caddy is formed with injection molding, or is formed of coated wire.

5. The dishwasher of claim 1, wherein the utensil caddy comprises an attachment member configured to attach the utensil caddy to a side of the dish rack.

6. The dishwasher of claim 5, wherein the attachment member is a snap fit member.

7. The dishwasher of claim 5, wherein the attachment member has at least one of a hole or a post configured to allow the attachment member to be screwed to the side of the dish rack.

8. The dishwasher of claim 1, further comprising a basket.

9. The dishwasher of claim 8, further comprising a moveable lid for the basket.

10. The dishwasher of claim 1, wherein the utensil caddy is selectively detachable from the dish rack.

11. The dishwasher of claim 1 wherein the second angle is different than the first angle, relative to the dish rack.

12. The dishwasher of claim 5 wherein the attachment member comprises a curved member configured to hook over a top edge of a side of the dish rack.

13. The dishwasher of claim 1 wherein there are multiple first and second slots arranged in an alternating sequence.

14. A dishwasher comprising:

a tub having walls at least partially defining a treating chamber with an access opening;

a door selectively closing the access opening;

a dish rack located within the tub and spaced from at least one of the walls or door to define a space; and a utensil caddy mounted to the dish rack and located within the space and exteriorly of the dish rack, the utensil caddy having a top and a bottom, with a first slot extending between the top and the bottom and being open at the top and the bottom, and a second slot extending between the top and the bottom and being open at the top and closed at the bottom, wherein the first slot is at a first angle relative to the dish rack and the second slot is at a second angle relative to the dish rack.

15. The dishwasher of claim 14 wherein there are multiple first and second slots arranged in an alternating sequence.

* * * * *